US011380278B2

(12) United States Patent
Tang

(10) Patent No.: US 11,380,278 B2
(45) Date of Patent: Jul. 5, 2022

(54) DRIVING CIRCUIT AND DISPLAY DEVICE

(71) Applicants: HKC Corporation Limited, Guangdong (CN); CHONGQING HKC OPTOELECTRONICS TECHNOLOGY CO., LTD., Chongqing (CN)

(72) Inventor: Li Tang, Chongqing (CN)

(73) Assignees: HKC CORPORATION LIMITED, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/298,045

(22) PCT Filed: Jun. 10, 2020

(86) PCT No.: PCT/CN2020/095272
§ 371 (c)(1),
(2) Date: May 28, 2021

(87) PCT Pub. No.: WO2020/248994
PCT Pub. Date: Dec. 17, 2020

(65) Prior Publication Data

US 2022/0101808 A1 Mar. 31, 2022

(30) Foreign Application Priority Data

Jun. 10, 2019 (CN) ..... 20190496686.0

(51) Int. Cl.
*G09G 3/36* (2006.01)

(52) U.S. Cl.
CPC ..... *G09G 3/3685* (2013.01); *G09G 3/3696* (2013.01); *G09G 2300/0833* (2013.01); *G09G 2320/0673* (2013.01)

(58) Field of Classification Search
None
See application file for complete search history.

(56) References Cited

U.S. PATENT DOCUMENTS 8,289,258 B2 10/2012 Cha et al.
8,446,402 B2 5/2013 Juyoung
(Continued)

FOREIGN PATENT DOCUMENTS

CN 101266762 A 9/2008
CN 101887699 A 11/2010
(Continued)

OTHER PUBLICATIONS

International Search Report for Application No. PCT/CN2020/095272 dated Sep. 15, 2020, 6 pages.
(Continued)

*Primary Examiner* — Aneeta Yodichkas

(57) ABSTRACT

A driving circuit and a display device. The driving circuit uses a binding point voltage generation circuit to output first voltages, second voltages and a plurality of first voltage-divided binding point voltages. The two second voltages are voltage divided by a first voltage dividing circuit to generate a plurality of second voltage-divided binding point voltages. Each first data driving circuit outputs first amplified binding point voltages. Each second data driving circuit outputs second amplified binding point voltages. The first voltages, the second voltages, each first amplified binding point voltage, and each second amplified binding point voltage are inputted to each first data driving circuit and each second data driving circuit.

19 Claims, 5 Drawing Sheets

(56) References Cited

U.S. PATENT DOCUMENTS

| | | | |
|---|---|---|---|
| 2015/0187300 | A1 | 7/2015 | Chen et al. |
| 2018/0204532 | A1 | 7/2018 | Kobayashi et al. |
| 2018/0210261 | A1 | 7/2018 | Chen et al. |
| 2019/0164470 | A1 | 5/2019 | Cho et al. |
| 2019/0333440 | A1 | 10/2019 | Chang |

FOREIGN PATENT DOCUMENTS

| | | | |
|---|---|---|---|
| CN | 103745703 | A | 4/2014 |
| CN | 204302618 | U | 4/2015 |
| CN | 106297721 | A | 1/2017 |
| CN | 106875896 | A | 6/2017 |
| CN | 107808644 | A | 3/2018 |
| CN | 208126060 | U | 11/2018 |
| CN | 108957852 | A | 12/2018 |
| CN | 109859684 | A | 6/2019 |
| CN | 110223654 | A | 9/2019 |
| KR | 20060131317 | A | 12/2006 |
| KR | 20120014422 | A | 2/2012 |

OTHER PUBLICATIONS

Chinese Office Action for Application No. 201910496686.0 dated May 25, 2020, 6 pages.

DRIVING CIRCUIT AND DISPLAY DEVICE

CROSS REFERENCE TO RELATED APPLICATIONS

This is a U.S. National Stage application of, and claims priority to, PCT/CN2020/095272, filed Jun. 10, 2020, which further claims priority to Chinese Patent Application No. 201910496686.0, filed Jun. 10, 2019, the disclosures of which are incorporated herein by reference in their entirety.

TECHNICAL FIELD

The present disclosure relates to the field of display technologies, and more particularly relates to a driving circuit and a display device.

BACKGROUND

The statements here only provide background information related to this application, and do not necessarily constitute prior art.

With the fiercer competition in the LCD panel industry, major panel manufacturers have become tighter in cost control. In terms of cost management, both the production cost of panel glass and the cost of peripheral electronic components are the key points of control. Like the structure of the two side strip control boards used in the liquid crystal driving circuit of the full high definition display panel, the timing controller, gamma chip, PWM (Pulse Width Modulation) chip, memory chip and the like can be placed in one main side strip control board, while there are almost no important electronic components on the other side strip control board.

When the adopted PWM chip can output several binding point voltages, these several binding point voltages are often used to generate other required binding point voltages by using resistors to dividing the voltages. Then half of the binding point voltages is output to data driving chips on the main side strip control board for gamma compensation, and the other half of the binding point voltages is output to the other side strip control board via FFC (Flexible Flat Cable), and correspondingly output to data driving chips on this side strip control board. Taking the common 14 gamma binding point voltages as an example, FFC with 7 metal wires is required to transmit the binding point voltages to the other side strip control board, and the FFC cost is high, thus further leading a high cost of the overall display product.

SUMMARY

Based on this, it is necessary to provide a driving circuit and a display device.

A driving circuit, includes:

a first control board, provided with a binding point voltage generating circuit and M first data driving circuits; the binding point voltage generating circuit outputs two first voltages, two second voltages, and N first voltage-divided binding point voltages;

the first voltages, the second voltages, and first voltage-divided binding point voltages are inputted into an i-th first data driving circuit; the i-th first data driving circuit outputs $K_i$ first amplified binding point voltages according to the $K_i$ first voltage-divided binding point voltages; the first amplified binding point voltages outputted by other first data driving circuits are further inputted into each of the first data driving circuits; $\Sigma_{i=1}^{M}K_i=N$, $K_i$, N, and M are all positive integers, and the first voltage-divided binding point voltages inputted into each of the first data driving circuits are different;

a connecting cable, which includes a first metal wire and a second metal wire; one of the second voltages is correspondingly inputted into one of a first end of the first metal wire and a first end of the second metal wire respectively; and a second control board, provided with a first voltage dividing circuit and P second data driving circuits; a first input terminal of the first voltage dividing circuit is connected to a second end of the first metal wire, a second input terminal of the first voltage dividing circuit is connected to a second end of the second metal wire, and the first voltage dividing circuit outputs N second voltage-divided binding point voltages according to the two second voltages;

the first voltages, the second voltages, and $K_j$ second voltage-divided binding point voltages are inputted into a j-th second data driving circuit; the j-th second data driving circuit outputs $K_j$ second amplified binding point voltages according to the $K_j$ second voltage-divided binding point voltages; the second amplified binding point voltages outputted by other second data driving circuits are further inputted into each of the second data driving circuits; $\Sigma_{j=1}^{P}K_j=N$, $K_j$ and P are all positive integers, and the second voltage-divided binding point voltages inputted into each of the second data driving circuits are different;

the first voltage-divided binding point voltages have a polarity opposite to that of the second voltage-divided binding point voltages, the first voltages have a polarity same as that of the first voltage-divided binding point voltages, and the second voltages have a polarity same as that of the second voltage-divided binding point voltages.

In the driving circuit provided by the embodiment of the present disclosure, the binding point voltage generating circuit on the first control board is used to output the first voltages, the second voltages, and N first voltage-divided binding point voltages, and the two second voltages are transmitted to the second control board through the first metal wire and the second metal wire on the connecting cable, after being voltage divided by the first voltage dividing circuit on the second control board, N second voltage-divided binding point voltages are generated. First voltage-divided binding point voltages are inputted into each of the first data driving circuits, the first voltage-divided binding point voltages inputted to each of the first data driving circuits are different, and each first data driving circuit outputs first amplified binding point voltages having a same number as the number of the inputted first voltage-divided binding point voltages. Similarly, second voltage-divided binding point voltages are inputted into each of the second data driving circuits, each of the second data driving circuits outputs second amplified binding point voltages having a same number as the number of the inputted second [HYJ1] voltage-divided binding point voltages, and the second voltage-divided binding point voltages inputted to each of the second data driving circuits are also different. To ensure that each of the driving circuits can normally drive the display panel to display, the first voltages, the second voltages, the first amplified binding point voltages outputted by the other first data driving circuits, and the second amplified binding point voltages need to be inputted into each of the first data driving circuits. Similarly, the first voltages, the second voltages, the first amplified binding point voltages, and the second amplified binding point voltages outputted by the other second data driving circuits need to be inputted into each of the second data driving circuits. With the drive circuit provided by the embodiment of the present disclosure, only a connecting cable with two metal wires is needed to realize the generation and output of the positive and negative binding point voltages, and the cost is low.

A display device, which includes a display panel and the above driving circuit, and the driving circuit is configured to drive the display panel to display.

DETAILED DESCRIPTION

Figure 1:
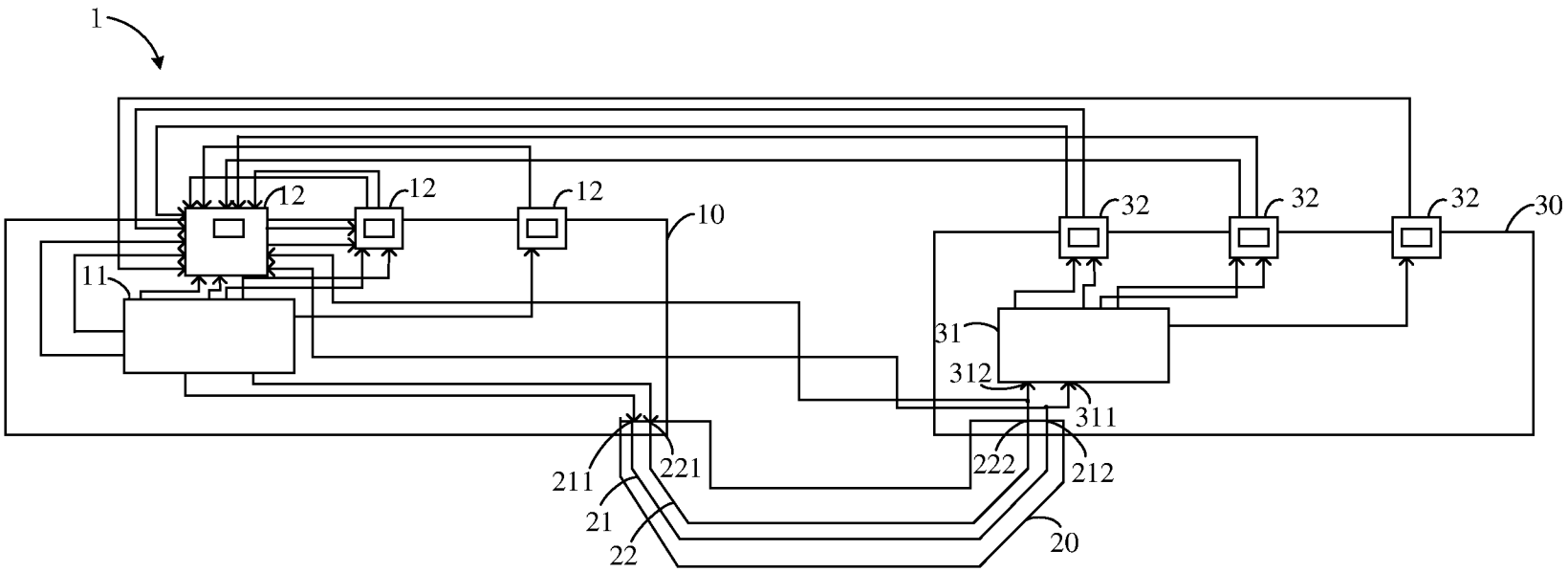
FIG. 1 is a schematic structure diagram of a driving circuit in an embodiment.

In order to facilitate the understanding of the present disclosure, the present disclosure will be described more fully hereinafter with reference to the related accompanying drawings. Preferable embodiments of the present disclosure are presented in the accompanying drawings. However, the present disclosure may be embodied in many different forms and is not limited to the embodiments described herein. Rather, these embodiments are provided so that the understanding of the content of the present disclosure will be more thorough.

It should be noted that when an element is considered being "connected" to another element, it is either directly connected to an element or indirectly connected to an element with a mediating element. The terms "install", "one terminal", "another terminal", and the like are used herein for illustrative purposes only.

All technical and scientific terms used herein have the same meaning as commonly understood by one of ordinary skill in the art to which the present disclosure applies, unless otherwise defined. The terms used in the specification of present disclosure herein are for the purpose of describing specific embodiments only and are not intended to limit the present disclosure. The term "and/or" used herein includes any and all combinations of one or more of the associated listed items.

For the method as described in the background, it is necessary to consider whether the voltage dividing resistors have a commonly used material, whether the wiring space is sufficient (usually use surface mounting type components with 0402 package specifications to save space), and the most important thing is whether the currents of the voltage dividing branches can meet the driving capability of the data driving chips, when the driving capability required by the data driving chips cannot be met, the driving capability of the binding point voltages needs to be amplified.

Taking the case of 14 binding point voltages as an example, the 1-th, 7-th, 8-th, and 14-th binding point voltages are generated by a PWM (Pulse Width Modulation) chip, and then the 1-th and 7-th binding point voltages are used to perform voltage division to obtain the 2-th, 3-th, 4-th, 5-th, and 6-th voltage-divided binding point voltages. Similarly, the 8-th and 14-th binding point voltages can be used to perform voltage division to generate the 9-th, 10-th, 11-th, 12-th and 13-th voltage-divided binding point voltages. Since these 10 voltages are obtained by the voltage divisions, their corresponding output currents may not meet the requirements for the driving capability required by the data driving chips, therefore the voltage-divided binding point voltages needs to be amplified. In the full high definition display device and the like, two control boards are generally used to form a drive circuit. One of the control boards performs voltage division to generate the above 10 binding point voltages. Five operational amplifier channels self-contained in the three data driving chips on the control board can be used to amplify the driving capability of the 2-th, 3-th, 4-th, 5-th, and 6-th voltage-divided binding point voltages. Then the remaining 9-th, 10-th, 11-th, 12-th, and 13-th voltage-divided binding point voltages need to be transmitted to the five operational amplifier channels self-contained in the three data driving chips on the other piece of control board, thus five more pins are required in the FFC to be used to transmit the 9-th, 10-th, 11-th, 12-th, and 13-th voltage-divided binding point voltages, and the cost of the FFC is increased, thereby increasing the cost of the display device as a whole.

Based on the foregoing problems, an embodiment of the present disclosure provides a driving circuit 1 as shown in FIG. 1, which includes:

a first control board 10, provided with a binding point voltage generating circuit 11 and M first data driving circuits 12; the binding point voltage generating circuit 11 outputs two first voltages, two second voltages, and N first voltage-divided binding point voltages;

the first voltages, the second voltages, and first voltage-divided binding point voltages are inputted into an i-th first data driving circuit 12; the i-th first data driving circuit 12 outputs $K_i$ first amplified binding point voltages according to the $K_i$ first voltage-divided binding point voltages; the first amplified binding point voltages outputted by other first data driving circuits 12 are further inputted into each of the first data driving circuits 12; $\Sigma_{i=1}^{M}K_i=N$, $K_i$, N, and M are all positive integers, and the first voltage-divided binding point voltages inputted into each of the first data driving circuits 12 are different;

a connecting cable 20, which includes a first metal wire 21 and a second metal wire 22; one of the second voltages is correspondingly inputted into each of a first end 211 of the first metal wire 21 and a first end 221 of the second metal wire 22 respectively; and a second control board 30, provided with a first voltage dividing circuit 31 and P second data driving circuits 32; a first input terminal 311 of the first voltage dividing circuit 31 is connected to a second end 212 of the first metal wire 21, a second input terminal 312 of the first voltage dividing circuit 31 is connected to a second end 222 of the second metal wire 22, and the first voltage dividing circuit 31 outputs N second voltage-divided binding point voltages according to the two second voltages;

the first voltages, the second voltages, and $K_j$ second voltage-divided binding point voltages are inputted into a j-th second data driving circuit 32; the j-th second data driving circuit 32 outputs $K_j$ second amplified binding point voltages according to the $K_j$ second voltage-divided binding point voltages; the second amplified binding point voltages outputted by other second data driving circuits 32 are further inputted into each of the second data driving circuits 32;

$\Sigma_{j=1}^{P}K_j=N$, $K_j$ and P are all positive integers, and the second voltage-divided binding point voltages inputted into each of the second data driving circuits 32 are different;

the first voltage-divided binding point voltages have a polarity opposite to that of the second voltage-divided binding point voltages, the first voltages have a polarity same as that of the first voltage-divided binding point voltages, and the second voltages have a polarity same as that of the second voltage-divided binding point voltages.

Figure 2:
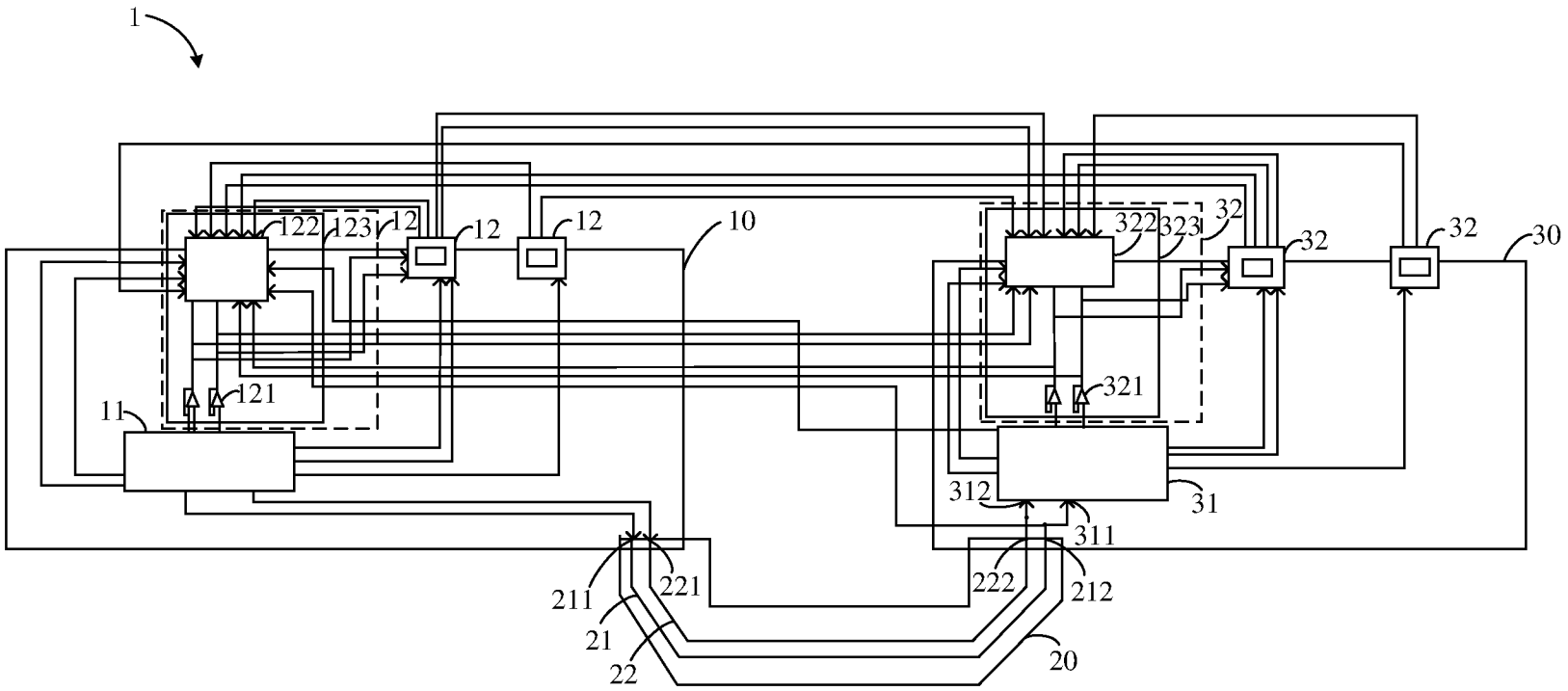
FIG. 2 is a schematic structure diagram of a driving circuit in another embodiment.
Figure 3:
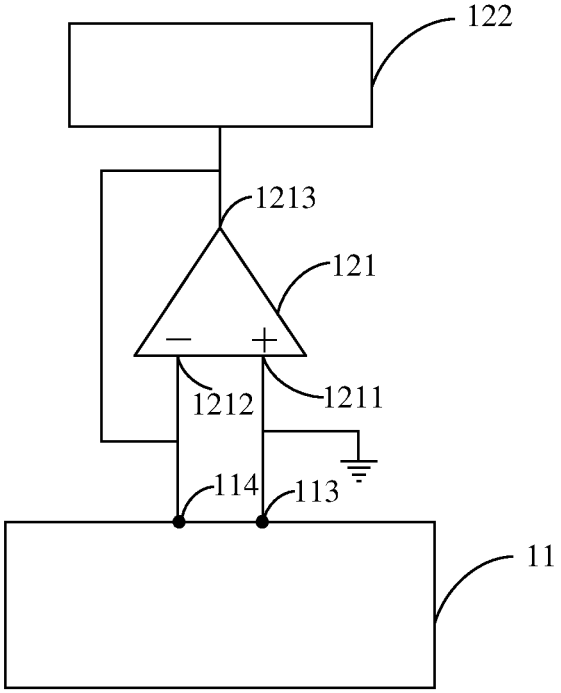
FIG. 3 is a schematic structure diagram of a first operational amplifier in an embodiment.
Figure 4:
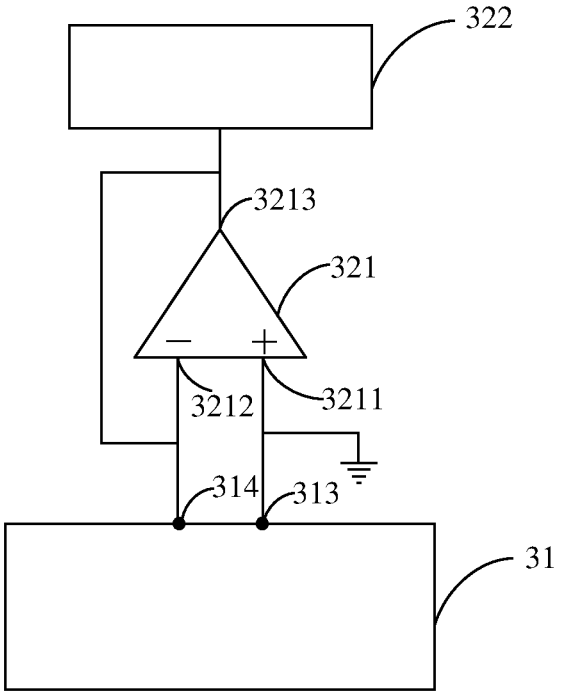
FIG. 4 is a schematic structure diagram of a second operational amplifier in an embodiment.

The first voltage-divided binding point voltages and the second voltage-divided binding point voltages refer to the binding point voltages generated by the voltage divisions. The first amplified binding point voltages refer to the binding point voltages outputted by the first data driving circuits 12, for example, outputted after amplification in current or only after data transmission, and there is a one-to-one correspondence relationship between the first amplified binding point voltages and the input first voltage-divided binding point voltages. Similarly, the second amplified binding point voltages refer to the binding point voltages outputted by the second data driving circuits 32, for example, outputted after amplification in current or only after data transmission. The above various binding point voltages are voltages used to perform gamma compensation on the data signals, thereby finally driving the display panel to display. For example, as shown in FIGS. 2 to 4, taking the common 14 binding point voltages as an example, the binding point voltage generating circuit 11 outputs two first voltages γ1 and γ7, two second voltages γ8 and γ14, and five first voltage-divided binding point voltages γ2, γ3, γ4, γ5, and γ6. Since the γ2 to γ6 are generated by voltage division, their corresponding current driving capabilities may not meet the requirements for data driving. The γ2 to γ6 are sent to the respective first data driving circuits 12 on the first control board 10 to amplify the driving capabilities of the γ2 to γ6 and then first amplified binding point voltages γ2', γ3', γ4', γ5' and γ6', γ1 are outputted. The γ2', γ3', γ4', γ5', γ6' and γ7, which form a set of positive polarity binding point voltages, are transmitted to each of the first data driving circuits 12 and each of the second data driving circuits 32. The second voltages γ8 and γ14 are transmitted to the second control board 30 via two metal wires on the connecting cable 20, and are voltage divided on the second control board 30 to obtain five second voltage-divided binding point voltages γ9, γ10, γ11, γ12 and γ13. The γ9 to γ13 are voltages generated by the voltage division, their driving capabilities may not meet the requirements for data driving. The γ9 to γ13 are sent to the second data driving circuits 32 on the second control board 30 to amplify the driving capabilities of the γ9 to γ13 and then second amplified binding point voltages γ9', γ10', γ11', γ12' and γ13' are outputted. The γ8, γ9', γ10', γ11', γ12', γ13', and γ14, which form a set of negative polarity binding point voltages, are sent to each of the first data driving circuits 12 and each of the second data driving circuits 32, so as to ensure that each first data driving circuit 12 and each second data driving circuit 32 receives 7 positive polarity binding point voltages and 7 negative polarity binding point voltages to drive the display of the display panel. On the premise of meeting the requirements for the data driving capability, only a connecting cable 20 with two metal wires is needed to achieve the compensations on the binding point voltages, the cost of connecting cable 20 is reduced, thereby reducing the costs of the driving circuit 1 and the overall display device. The connecting cable 20 may be FFC (Flexible Flat Cable) or the like.

In the driving circuit 1 provided by the embodiment of the present disclosure, the binding point voltage generating circuit 11 on the first control board 10 is used to output the first voltages, the second voltages, and N first voltage-divided binding point voltages, and the two second voltages are transmitted to the second control board 30 through the first metal wire 21 and the second metal wire 22 on the connecting cable 20, after being voltage divided by the first voltage dividing circuit 31 on the second control board 30, N second voltage-divided binding point voltages are generated. First voltage-divided binding point voltages are inputted into each of the first data driving circuits 12, the first voltage-divided binding point voltages inputted to each of the first data driving circuits 12 are different, and each first data driving circuit 12 outputs first amplified binding point voltages having a same number as the number of the input first voltage-divided binding point voltages. Similarly, second voltage-divided binding point voltages are inputted into each of the second data driving circuits 32, each of the second data driving circuits 32 outputs second amplified binding point voltages having a same number as the number of the inputted second voltage-divided binding point voltages, and the second voltage-divided binding point voltages inputted to each of the second data driving circuits 32 are also different. To ensure that each of the driving circuits can normally drive the display panel to display, the first voltages, the second voltages, the first amplified binding point voltages outputted by the other first data driving circuits 12, and the second amplified binding point voltages need to be inputted into each of the first data driving circuits 12. Similarly, the first voltages, the second voltages, the first amplified binding point voltages, and the second amplified binding point voltages outputted by the other second data driving circuits 32 need to be inputted into each of the second data driving circuits 32. With the drive circuit 1 provided by the embodiment of the present disclosure, only a connecting cable 20 with two metal wires (which can be a flexible flat cable) is needed to generate and output the positive and negative binding point voltages, and the cost is low.

In one of the embodiments, the binding point voltage generating circuit 11 includes: a reference voltage generating circuit 111, configured to output the above first voltages and the above second voltages; and a second voltage dividing circuit 112, configured to output the above first voltage-divided binding point voltages according to the two first voltages.

The reference voltage generating circuit 111 is a chip that can generate a plurality different voltages. The second voltage dividing circuit 112 is a circuit that can realize voltage division. Specifically, the reference voltage generating circuit 111 outputs two first voltages and sends them to the second voltage dividing circuit 112, and the second voltage dividing circuit 112 obtains a plurality first voltage-divided binding point voltages. The two first voltages and the plurality first voltage-divided binding point voltages constitute the positive polarity (or negative polarity) binding point voltages. Meanwhile, the two second voltages outputted by the reference voltage generating circuit 111 are transmitted to the first voltage dividing circuit 31 through the connecting cable 20, and the first voltage dividing circuit 31 performs voltage division on the two second voltages to output a plurality second voltage-divided binding point voltages. The two second voltages and the plurality second voltage-divided binding point voltages constitute the negative polarity (or positive polarity) binding point voltages. The processes for the positive polarity binding point voltages and the negative polarity binding point voltages are performed on the first control board 10 and the second control board 30 respectively to obtain the binding point voltages that can meet the requirements for the data driving capability, so as to drive the data display. The reference voltage generating circuit 111 may be a PWM chip.

In one of the embodiments, the first voltage-divided binding point voltages are within a voltage range formed of the two first voltages. The two first voltages are different magnitudes, and the first voltage-divided binding point voltages, which are generated through performing voltage division according to the two first voltages by the second voltage dividing circuit 112, are greater than the smaller first voltage and smaller than the larger first voltage.

In one of the embodiments, the second voltage-divided binding point voltages are within a voltage range formed of the two second voltages. Regarding the second voltage-divided binding point voltages, same as the above first voltage-divided binding point voltages, their values does not exceed the voltage range formed of the two second voltages.

In one of the embodiments, each of the first data driving circuits 12 includes: a plurality of first operational amplifiers 121, configured to be fixed on a first chip on film 123 and electrically connected to the first chip on film 123, each of the first operational amplifiers 121 is configured to output one of first amplified binding point voltage according to one of first voltage-divided binding point voltage input, and the first voltage-divided binding point voltages inputted into each of the first operational amplifiers 121 are different; and a first processor 122, configured to be fixed on the first chip on film 123 and electrically connected to the first chip on film 123, and the first voltages, the second voltages, each of the first amplified binding point voltages, and each of the second amplified binding point voltages are inputted into the first processor 122.

The first operational amplifiers 121 may be voltage followers or other operational amplifiers with current amplification capability. Each of the first chip on films 123 is equipped with one first data driving circuit 12 thereon, this first data driving circuit 12 has a plurality of first operational amplifiers 121 and one first processor 122. With operational amplification capability self-contained in each of the first data driving circuits 12, the first voltage-divided binding point voltages generated by voltage division are sent to the respective first operational amplifiers 121 to be processed by amplification (if the driving capability is insufficient, it needs to be operationally amplified before being output) or to be processed by data transmission (if the driving capability can meet the requirements, it can be transmitted with equal value through the operational amplifier), to generate the first amplified binding point voltages, so as to ensure that the driving capabilities of the binding point voltages for compensating the data signals can meet the requirements for driving the display panel. An output terminal of the first processor 122 is connected to the display panel. The first processor 122 receives the first voltages, the second voltages, the second amplified binding point voltages and the first amplified binding point voltages, receives 14 or 16 binding point voltages that can meet the requirements for data driving, so as to drive the display of the display panel.

In one of the embodiments, each of the first data driving circuits 12 includes two first operational amplifiers 121. As shown in FIG. 2, each of the first data driving circuits 12 includes two first operational amplifiers 121. For a display panel that needs to use 14 binding point voltages for compensation, three first data driving circuits 12 can be disposed on the first control board 10, the five first voltage-divided binding point voltages obtained by voltage division are divided into two, two, and one of binding point voltages and are respectively transmitted to the respective first data driving circuits 12, so as to be connected to input terminals of the first operational amplifiers 121 in a one to one correspondence.

In one of the embodiments, each of the second data driving circuits 32 includes: a plurality of second operational amplifiers 321, configured to be fixed on a second chip on film 323 and electrically connected to the second chip on film 323, one of second voltage-divided binding point voltages is inputted into an input terminal of each of the second operational amplifiers 321, and the second voltage-divided binding point voltages inputted into each of the second operational amplifiers 321 are different, an output terminal of each of the second operational amplifiers 321 outputs a second amplified binding point voltage corresponding to the second voltage-divided binding point voltage; and a second processor 322, configured to be fixed on the second chip on film 323 and electrically connected to the second chip on film 323, and the first voltages, the second voltages, each of the first amplified binding point voltages, and each of the second amplified binding point voltages are inputted into the second processor 322.

The interpretation of the second data driving circuit 32 is the same as that of the first data driving circuit 12 in the above embodiments, which will not be repeated here. Those skilled in the art can know the working process of the second data driving circuit 32 according to the working principle of the first data driving circuit 12.

In one of the embodiments, each of the second data driving circuits 32 includes two second operational amplifiers 321. As shown in FIG. 2, each of the second data driving circuits 32 includes two second operational amplifiers 321. For a display panel that needs to use 14 binding point voltages for compensation, three second data driving circuits 32 can be disposed on the second control board 30, the five second voltage-divided binding point voltages obtained by voltage division are divided into two, two, and one of binding point voltages and are respectively transmitted to the respective second data driving circuits 32, so as to be connected to input terminals of the second operational amplifiers 321 in a one to one correspondence.

In one of the embodiments, as shown in FIG. 3, a first-type output terminal 113 of the binding point voltage generating circuit 11 is connected to a non-inverting input terminal 1211 of a corresponding first operational amplifier 121, and an inverting input terminal 1212 of the first operational amplifier 121 is connected to its own output terminal 1213; a second-type output terminal 114 of the binding point voltage generating circuit 11 is connected to the inverting input terminal 1212 of the corresponding first operational amplifier 121, and the inverting input terminal 1212 of the first operational amplifier 121 is connected to Its own output terminal 1213, and the non-inverting input terminal 1211 of the first operational amplifier 121 is grounded. A current corresponding to the first voltage-divided binding point voltage outputted by the first-type output terminal 113 of the binding point voltage generating circuit 11 is less than a preset driving current, and a current corresponding to the first voltage-divided binding point voltage outputted by the second-type output terminal 114 of the binding point voltage generating circuit 11 is greater than the preset driving current, the preset driving current is configured to characterize a driving capability required by the display panel.

The preset driving current may be a minimum current required for driving the display panel. If a first voltage-divided binding point voltage generated by voltage division does not meet the requirements for a current of data driving, then this way of first voltage-divided binding point voltage needs to be amplified in driving capability. This way of first voltage-divided binding point voltage is inputted into the non-inverting input terminal 1211 of the first operational amplifier 121, the inverting input terminal 1212 and the output terminal 1213 of the first operational amplifier 121 are connected to form a negative feedback, and this way of first voltage-divided binding point voltage is amplified by the first operational amplifier 121 and then one of first amplified binding point voltages is outputted, and the current driving capability is amplified. If a first voltage-divided binding point voltage can meet the requirements for a current of data driving, then this first voltage-divided binding point voltage has no need to be signal amplified. This first voltage-divided binding point voltage is inputted into the inverting input terminal 1212 of the first operational amplifier 121, and the non-inverting input terminal 1211 is grounded, such that the non-inverting input of the first operational amplifier 121 is zero, and the voltage-divided binding point voltage is directly outputted via the inverting input terminal 1212 of the first operational amplifier 121 to generate the first amplified binding point voltage, and the amplification factor is 1, namely it plays a role of signal transmission. With the structure provided by the embodiment of the present disclosure, different connection relationships can be established with the first operational amplifier 121 according to the driving capabilities of each of the voltage-divided binding point voltages, thus the amplification function can be activated or not, which is suitable for various types of display panels.

In one of the embodiments, as shown in FIG. 4, a first-type output terminal 313 of the first voltage dividing circuit 31 is connected to a non-inverting input terminal 3211 of a corresponding second operational amplifier 321, and an inverting input terminal 3212 of the second operational amplifier 321 is connected to its own output terminal 3213; a second-type output terminal 314 of the first voltage dividing circuit 31 is connected to the inverting input terminal 3212 of the corresponding second operational amplifier 321, and the inverting input terminal 3212 of the second operational amplifier 321 is connected to Its own output terminal 3213, and the non-inverting input terminal 3211 of the second operational amplifier 321 is grounded. A current corresponding to the second voltage-divided binding point voltage outputted by the first-type output terminal 313 of the first voltage dividing circuit 31 is less than a preset driving current, and a current corresponding to the second voltage-divided binding point voltage outputted by the second-type output terminal 314 of the first voltage dividing circuit 31 is greater than the preset driving current.

For each of the second voltage-divided binding point voltages generated by voltage division by the first voltage dividing circuit 31, it has the same implementation process as that of the amplification or non-amplification of the voltage-divided binding point voltage in the above embodiments, which will not be repeated here. According to whether a current corresponding to a second voltage-divided binding point voltage can meet the requirements for data driving capability, different connection relationships with the second operational amplifier 321 can be established to achieve amplification or non-amplification in current, so as to output a set of binding point voltages that can meet the requirements for driving the display panel.

Figure 5:
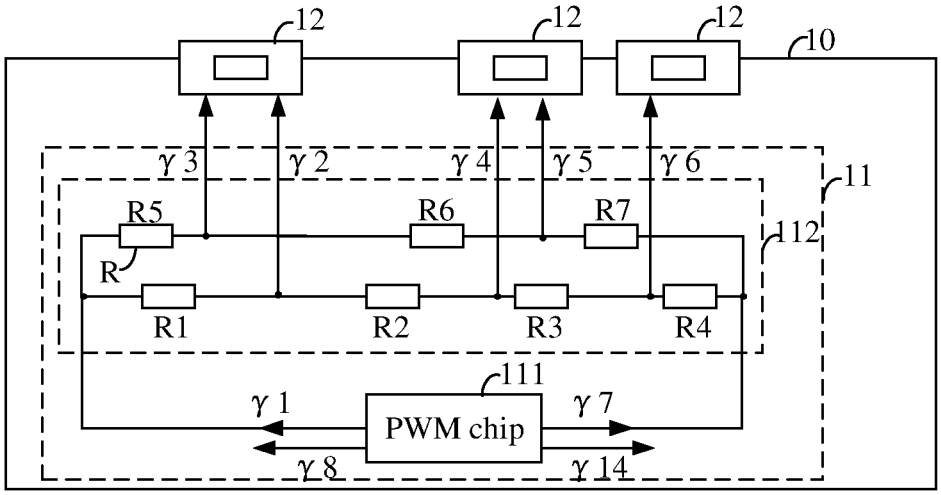
FIG. 5 is a schematic structure diagram of a binding point voltage generating circuit in an embodiment.

In one of the embodiments, as shown in FIG. 5, the second voltage dividing circuit 112 includes a plurality of voltage dividing resistors R connected in series, and the two first voltages are respectively inputted into two ends of the one or more voltage dividing resistors R. One of first voltage-divided binding point voltage is outputted between every two adjacent voltage dividing resistors R. Taking the 5 first voltage-divided binding point voltages in FIG. 5 as an example, the reference voltage generating circuit 111 outputs two first voltages γ1 and γ7, and the γ1 and γ7 are inputted into two ends of a unit consisting of the one or more voltage dividing resistors R to provide a reference voltage for the seven voltage dividing resistors (R1 to R7), and one of first voltage-divided binding point voltage is outputted between every two adjacent voltage dividing resistors R.

Figure 6:
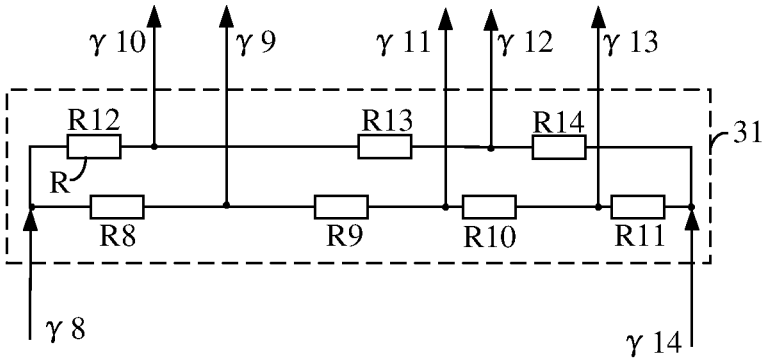
FIG. 6 is a schematic structure diagram of a first voltage dividing circuit in an embodiment.

In one of the embodiments, as shown in FIG. 6, the first voltage dividing circuit 31 includes a plurality of voltage dividing resistors R connected in series, and the two second voltages are respectively inputted into two ends of the one or more voltage dividing resistors R. One of second voltage-divided binding point voltage is outputted between every two adjacent voltage dividing resistors R. Taking the 5 second voltage-divided binding point voltages in FIG. 6 as an example, the reference voltage generating circuit 111 outputs two second voltages γ8 and γ14, and the γ8 and γ14 are inputted into two ends of a unit consisting of the one or more voltage dividing resistors R to provide a reference voltage for the seven voltage dividing resistors (R8 to R14), and one of second voltage-divided binding point voltage is outputted between every two adjacent voltage dividing resistors R.

Figure 7:
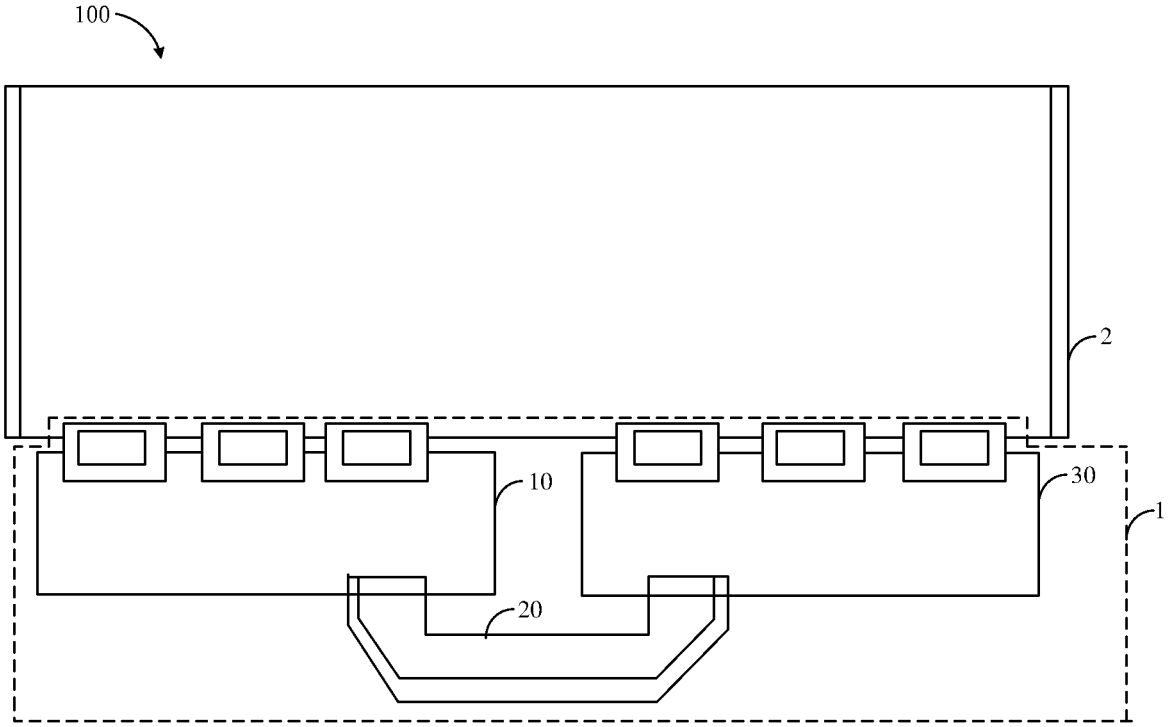
FIG. 7 is a schematic structural diagram of a display device in an embodiment.

On the other hand, as shown in FIG. 7, an embodiment of the present disclosure further provides a display device 100, which includes a display panel 2 and the above driving circuit 1, and the driving circuit 1 is configured to drive the display panel 2 to display.

The definitions of the first voltage-divided binding point voltages, the first voltage dividing circuit 31 and the like are the same as those in the above embodiments, which will not be repeated here. In the display device 100 provided by the embodiments of the present disclosure, only a connecting cable 20 with two metal wires is needed to realize the generation and transmission of the positive and negative polarity binding point voltages, and the cost is low, and by using the operational amplifier self-contained on each of the data driving circuits, the volume and the consumables can be further reduced.

The technical features of the above-described embodiments can be combined arbitrarily. To simplify the description, not all possible combinations of the technical features in the above embodiments are described. However, all of the combinations of these technical features should be considered as within the scope of this disclosure, as long as such combinations do not contradict with each other.

The above embodiments merely illustrate several embodiments of the present disclosure, and the description thereof is specific and detailed, but it shall not be constructed as limiting the scope of this application. It should be noted that for those of ordinary skill in the art, without departing from the concept of this disclosure, several modifications and improvements can be made, which are all within the protection scope of the present disclosure. Therefore, the protection scope of the present disclosure shall be subject to the appended claims.

What is claimed is:

1. A driving circuit, comprising:

a first control board, provided with a binding point voltage generating circuit and M first data driving circuits; the binding point voltage generating circuit outputting two first voltages, two second voltages, and N first voltage-divided binding point voltages;

the first voltages, the second voltages, and the first voltage-divided binding point voltages being inputted into an i-th first data driving circuit; the i-th first data driving circuit outputting $K_i$ first amplified binding point voltages according to the $K_i$ first voltage-divided binding point voltages; the first amplified binding point voltages outputted by other first data driving circuits being further inputted into each of the first data driving circuits; wherein, $\Sigma_{i=1}^{M}K_i=N$, $K_i$, N, and M are all positive integers, and the first voltage-divided binding point voltages inputted into each of the first data driving circuits are different;

a connecting cable, comprising a first metal wire and a second metal wire; one of the second voltages being correspondingly inputted into one of a first end of the first metal wire and a first end of the second metal wire respectively; and a second control board, provided with a first voltage dividing circuit and P second data driving circuits; a first input terminal of the first voltage dividing circuit being connected to a second end of the first metal wire, a second input terminal of the first voltage dividing circuit being connected to a second end of the second metal wire, and the first voltage dividing circuit outputting N second voltage-divided binding point voltages according to the two second voltages;

the first voltages, the second voltages, and $K_j$ second voltage-divided binding point voltages being inputted into a j-th second data driving circuit; the j-th second data driving circuit outputting $K_j$ second amplified binding point voltages according to the $K_j$ second voltage-divided binding point voltages; the second amplified binding point voltages outputted by other second data driving circuits being further inputted into each of the second data driving circuits; wherein, $\Sigma_{j=1}^{P}K_j=N$, $K_j$ and P are all positive integers, and the second voltage-divided binding point voltages inputted into each of the second data driving circuits are different;

wherein, the first voltage-divided binding point voltages have a polarity opposite to that of the second voltage-divided binding point voltages, the first voltages have a polarity same as that of the first voltage-divided binding point voltages, and the second voltages have a polarity same as that of the second voltage-divided binding point voltages.

2. The driving circuit according to claim 1, wherein the first amplified binding point voltage is a binding point voltage outputted after amplification or data transmission by the first data driving circuit.

3. The driving circuit according to claim 1, wherein the second amplified binding point voltage is a binding point voltage outputted after amplification or data transmission by the second data driving circuit.

4. The driving circuit according to claim 1, wherein the binding point voltage generating circuit comprises:

a reference voltage generating circuit, configured to output the first voltages and the second voltages; and a second voltage dividing circuit, configured to output the first voltage-divided binding point voltages according to the two first voltages.

5. The driving circuit of claim 4, wherein the reference voltage generating circuit is a PWM chip.

6. The driving circuit according to claim 4, wherein the first voltage-divided binding point voltages are within a voltage range formed of the two first voltages.

7. The driving circuit according to claim 6, wherein the two first voltages have different magnitudes.

8. The driving circuit according to claim 4, wherein the second voltage-divided binding point voltages are within a voltage range formed of the two second voltages.

9. The driving circuit according to claim 8, wherein the two second voltages have different magnitudes.

10. The driving circuit of claim 4, wherein the second voltage dividing circuit comprises a plurality of voltage dividing resistors connected in series, and the two first voltages are respectively inputted into two ends of the plurality of voltage dividing resistors; one of first voltage-divided binding point voltages is outputted between every two adjacent voltage dividing resistors.

11. The driving circuit according to claim 1, wherein each of the first data driving circuits comprises:

a plurality of first operational amplifiers, configured to be fixed on a first chip on film and electrically connected to the first chip on film, each of the first operational amplifiers being configured to output one of first amplified binding point voltages according to one of inputted first voltage-divided binding point voltages, and the first voltage-divided binding point voltages inputted into each of the first operational amplifiers being different; and a first processor, configured to be fixed on the first chip on film and electrically connected to the first chip on film, and the first voltages, the second voltages, each of the first amplified binding point voltages, and each of the second amplified binding point voltages being inputted into the first processor.

12. The driving circuit according to claim 11, wherein the first operational amplifier comprises a voltage follower with current amplification capability.

13. The driving circuit of claim 11, wherein each of the first data driving circuits comprises two first operational amplifiers.

14. The driving circuit according to claim 11, wherein each of the second data driving circuits comprises:

a plurality of second operational amplifiers, configured to be fixed on a second chip on film and electrically connected to the second chip on film, each of the second operational amplifiers being configured to output one of second amplified binding point voltages according to one of inputted second voltage-divided binding point voltages, and the second voltage-divided binding point voltages inputted into each of the second operational amplifiers being different; and a second processor, configured to be fixed on the second chip on film and electrically connected to the second chip on film, and the first voltages, the second voltages, each of the first amplified binding point voltages, and each of the second amplified binding point voltages being inputted into the second processor.

15. The driving circuit of claim 14, wherein each of the second data driving circuits comprises two second operational amplifiers.

16. The driving circuit of claim 14, wherein a first-type output terminal of the first voltage dividing circuit is connected to a non-inverting input terminal of a corresponding second operational amplifier, and an inverting input terminal of the second operational amplifier is connected to its own output terminal;

a second-type output terminal of the first voltage dividing circuit is connected to the inverting input terminal of the corresponding second operational amplifier, and the inverting input terminal of the second operational amplifier is connected to Its own output terminal, and the non-inverting input terminal of the second operational amplifier is grounded;

wherein, a current corresponding to the second voltage-divided binding point voltage outputted by the first-type output terminal of the first voltage dividing circuit is less than a preset driving current, and a current corresponding to the second voltage-divided binding point voltage outputted by the second-type output terminal of the first voltage dividing circuit is greater than the preset driving current.

17. The driving circuit of claim 11, wherein a first-type output terminal of the binding point voltage generating circuit is connected to a non-inverting input terminal of a corresponding first operational amplifier, and an inverting input terminal of the first operational amplifier is connected to its own output terminal;

a second-type output terminal of the binding point voltage generating circuit is connected to the inverting input terminal of the corresponding first operational amplifier, and the inverting input terminal of the first operational amplifier is connected to its own output terminal, and the non-inverting input terminal of the first operational amplifier is grounded;

wherein, a current corresponding to the first voltage-divided binding point voltage outputted by the first-type output terminal of the binding point voltage generating circuit is less than a preset driving current, and a current corresponding to the first voltage-divided binding point voltage outputted by the second-type output terminal of the binding point voltage generating circuit is greater than the preset driving current, the preset driving current is configured to characterize a driving capability required by a display panel.

18. The driving circuit of claim 1, wherein the first voltage dividing circuit comprises a plurality of voltage dividing resistors connected in series, and the two second voltages are respectively inputted into two ends of the plurality of voltage dividing resistors; one of second voltage-divided binding point voltages is outputted between every two adjacent voltage dividing resistors.

19. A display device, comprising a display panel and a driving circuit, the driving circuit being configured to drive the display panel to display;

the driving circuit comprising:

a first control board, provided with a binding point voltage generating circuit and M first data driving circuits; the binding point voltage generating circuit outputting two first voltages, two second voltages, and N first voltage-divided binding point voltages;

the first voltages, the second voltages, and first voltage-divided binding point voltages being inputted into an i-th first data driving circuit; the i-th first data driving circuit outputting $K_i$ first amplified binding point voltages according to the $K_i$ first voltage-divided binding point voltages; the first amplified binding point voltages outputted by other first data driving circuits being further inputted into each of the first data driving circuits; wherein, $\Sigma_{i=1}^{M}K_i=N$, $K_i$, N, and M are all positive integers, and the first voltage-divided binding point voltages inputted into each of the first data driving circuits are different;

a connecting cable, comprising a first metal wire and a second metal wire; one of the second voltages being correspondingly inputted into one of a first end of the first metal wire and a first end of the second metal wire respectively; and a second control board, provided with a first voltage dividing circuit and P second data driving circuits; a first input terminal of the first voltage dividing circuit being connected to a second end of the first metal wire, a second input terminal of the first voltage dividing circuit being connected to a second end of the second metal wire, and the first voltage dividing circuit outputting N second voltage-divided binding point voltages according to the two second voltages;

the first voltages, the second voltages, and $K_j$ second voltage-divided binding point voltages being inputted into a j-th second data driving circuit; the j-th second data driving circuit outputting $K_j$ second amplified binding point voltages according to the $K_j$ second voltage-divided binding point voltages; the second amplified binding point voltages outputted by other second data driving circuits being further inputted into each of the second data driving circuits; wherein, $\Sigma_{j=1}^{P}K_j=N$, $K_j$ and P are all positive integers, and the second voltage-divided binding point voltages inputted into each of the second data driving circuits are different;

wherein, the first voltage-divided binding point voltages have a polarity opposite to that of the second voltage-divided binding point voltages, the first voltages have a polarity same as that of the first voltage-divided binding point voltages, and the second voltages have a polarity same as that of the second voltage-divided binding point voltages.

* * * * *